US008720592B2

(12) United States Patent
Hubert et al.

(10) Patent No.: US 8,720,592 B2
(45) Date of Patent: May 13, 2014

(54) EXPANSION NOZZLE ASSEMBLY TO PRODUCE INERT GAS BUBBLES

(71) Applicant: Tyco Fire Poducts LP, Lansdale, PA (US)

(72) Inventors: Mitchell J. Hubert, Menominee, MI (US); Stephen A. Barker, Menominee, MI (US); Donald Bjorkman, Menominee, MI (US); Gregory R. Walker, Marinette, MI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 13/655,368

(22) Filed: Oct. 18, 2012

(65) Prior Publication Data

US 2013/0037282 A1 Feb. 14, 2013

Related U.S. Application Data

(63) Continuation of application No. 11/350,684, filed on Feb. 9, 2006, now Pat. No. 8,322,633.

(51) Int. Cl.

| | |
|---|---|
| ***A62C 2/00*** | (2006.01) |
| ***A62C 35/00*** | (2006.01) |
| ***A62C 3/07*** | (2006.01) |
| ***B05B 7/30*** | (2006.01) |

(52) U.S. Cl.

USPC ..... 169/44; 169/14; 169/15; 169/54; 169/62; 239/343; 239/590

(58) Field of Classification Search

USPC ..... 239/343, 418, 428.5, 432, 434, 462, 239/499, 590, 590.3; 169/14, 15, 37, 44, 169/54, 62

See application file for complete search history.

(56) References Cited

U.S. PATENT DOCUMENTS

| | | | |
|---|---|---|---|
| 711,267 | A | 10/1902 | Swensson |
| 1,117,228 | A | 11/1914 | Overbeke |
| 1,427,910 | A | 9/1922 | Quinn |
| 2,630,183 | A | 3/1953 | Foutz |
| 2,774,583 | A | 12/1956 | Haftke |
| 2,887,275 | A | 5/1959 | Dixon et al. |

(Continued)

FOREIGN PATENT DOCUMENTS

EP 119527 A2 * 9/1984

OTHER PUBLICATIONS

Werfelman, Linda, "Dousing the Flames", Aerosafety World, Nov. 2009, pp. 39-43.

(Continued)

*Primary Examiner* — Ryan Reis
(74) *Attorney, Agent, or Firm* — Perkins Coie LLP

(57) ABSTRACT

A nozzle assembly for encapsulating a gaseous solution in bubbles comprises a discharge tube having a diffuser and a foam solution spray nozzle mounted therein. The discharge tube has upstream and downstream ends. The discharge tube has a front face at the upstream end with a first opening configured to be joined to a gas supply line that provides a gaseous solution and a second opening configured to receive a non-expanded foam solution. The downstream end of the discharge tube is open. A chamber is formed within the discharge tube to receive the gaseous solution at the upstream end and release the gaseous solution through the diffuser into the discharge tube towards the downstream end.

32 Claims, 6 Drawing Sheets

(56) References Cited

U.S. PATENT DOCUMENTS

| | | | | |
|---|---|---|---|---|
| 3,094,171 | A | | 6/1963 | Gagliardo |
| 3,388,868 | A | | 6/1968 | Williams |
| 3,428,131 | A | | 2/1969 | Winslow |
| 3,780,812 | A | | 12/1973 | Lambert |
| 3,920,177 | A | * | 11/1975 | Wilson et al. ..... 228/218 |
| 4,213,936 | A | | 7/1980 | Lodrick |
| 4,520,949 | A | | 6/1985 | Seitz et al. |
| 4,531,588 | A | * | 7/1985 | Brunsicke ..... 169/9 |
| 4,603,813 | A | | 8/1986 | Leugering |
| 4,640,461 | A | | 2/1987 | Williams |
| 4,646,848 | A | | 3/1987 | Bruensicke |
| 4,662,454 | A | | 5/1987 | Uchiyama et al. |
| 4,732,181 | A | | 3/1988 | Sollander et al. |
| 4,944,460 | A | | 7/1990 | Steingass |
| 5,012,979 | A | | 5/1991 | Williams |
| 5,054,688 | A | | 10/1991 | Grindley |
| 5,085,371 | A | | 2/1992 | Paige |
| 5,305,957 | A | | 4/1994 | Szocs |
| 5,330,105 | A | | 7/1994 | Kaylor |
| 5,373,991 | A | | 12/1994 | Nelson |
| 5,381,957 | A | | 1/1995 | Bianco |
| 5,404,957 | A | | 4/1995 | McCormack |
| 5,553,785 | A | | 9/1996 | Haruch |
| 5,816,503 | A | | 10/1998 | Nelson |
| 5,848,752 | A | | 12/1998 | Kolacz et al. |
| 5,857,627 | A | | 1/1999 | Horwell et al. |
| 5,860,598 | A | | 1/1999 | Cruz |
| 6,047,903 | A | | 4/2000 | Meyer |
| 6,173,908 | B1 | | 1/2001 | Bureaux et al. |
| 6,375,096 | B1 | | 4/2002 | Rashidi |
| 6,749,027 | B1 | | 6/2004 | Crabtree et al. |
| 6,868,990 | B2 | | 3/2005 | Cater et al. |
| 7,165,627 | B2 | | 1/2007 | Hutter et al. |
| 7,806,195 | B2 | | 10/2010 | Popp et al. |
| 7,810,577 | B2 | | 10/2010 | Popp et al. |
| 7,975,773 | B2 | | 7/2011 | Murata et al. |
| 2005/0045345 | A1 | | 3/2005 | Arvidson et al. |
| 2009/0315726 | A1 | | 12/2009 | Popp et al. |

OTHER PUBLICATIONS

Jet-X® High Expansion Foam Generators, Ansul Incorporated, 4 pages.

* cited by examiner

EXPANSION NOZZLE ASSEMBLY TO PRODUCE INERT GAS BUBBLES

CROSS REFERENCE TO RELATED APPLICATIONS INCORPORATED BY REFERENCE

This application is a continuation of U.S. patent application Ser. No. 11/350,684, filed Feb. 9, 2006, which is incorporated herein in its entirety by reference.

BACKGROUND OF THE INVENTION

This invention relates generally to fire extinguishing systems, and more particularly, to expansion nozzle assemblies used to dispense foam in a fire extinguishing system.

Enclosed areas such as cargo holds within an airplane, inside cargo containers held within the cargo hold of an airplane, computer rooms, equipment rooms, and the like all may contain combustible materials which need to be extinguished during a fire. The type of combustible material and the use of the enclosed area may determine how a thermal event is extinguished.

Different types of fire extinguishing systems exist. A cargo hold, for example, may use a high or medium foam expansion system while a commercial office building may use a sprinkler system. In a foam expansion system, an expansion nozzle expands a foam solution into a blanket of foam bubbles. The nozzle may extend within a discharge tube and accepts the foam solution from a container under pressure or from an atmospheric tank and pump assembly. The discharge tube may be open or have an opening to the atmosphere or ambient air proximate the end where the foam solution is introduced, or may have orifices open to the atmosphere along the discharge tube.

When the system is activated, the foam solution is discharged into the nozzle. The nozzle sprays the foam solution in a spray pattern onto a screen at an opposite end of the discharge tube. The pressure in the discharge tube results in a Venturi effect, pulling air into the discharge tube and causing bubbles to form on an opposite side of the screen. The bubbles are released into the atmosphere through an open end of the discharge tube. When the bubbles break, the atmosphere or room air within the bubbles is released. The foam solution provides a wetting and extinguishing effect, but does not create an inert atmosphere in which combustion cannot take place. Therefore, combustible materials may re-kindle as a result of deep-seated combustion.

Other fire extinguishing systems attempt to maintain an atmosphere in which combustion cannot take place by injecting inert gas into the enclosed area. The inert gas mixes with and displaces the ambient air, and thus escapes or leaks from the enclosed area with the ambient air, making it difficult to maintain a desired percentage of inert gas. Optionally, intermittent additional discharges of inert gas or a slow continuous discharge of inert gas after the initial discharge may be used to compensate for the leakage. This requires a more complicated discharge system and more inert gas is needed.

Thus, the bubbles enclosing ambient air and/or the injection of inert gas as discussed above may not maintain a desired inerting atmosphere within the enclosed area. The inert gas may easily escape the area and is diluted with air. Also, adding additional gas periodically or continuously to maintain the inerting atmosphere requires more product and is thus more expensive.

Therefore, a need exists for an apparatus to maintain an inerting atmosphere in an enclosed area. Certain embodiments of the present invention are intended to meet these needs and other objectives that will become apparent from the description and drawings set forth below.

BRIEF DESCRIPTION OF THE INVENTION

In one embodiment, a nozzle assembly for encapsulating a gaseous solution in bubbles comprises a discharge tube with a diffuser and a foam solution nozzle held within. The discharge tube has upstream and downstream ends. The discharge tube has a front face at the upstream end with a first opening configured to be joined to a gas supply line that provides a gaseous solution and a second opening configured to receive a non-expanded foam solution. The downstream end of the discharge tube is open. A chamber is formed within the discharge tube. The chamber receives the gaseous solution at the upstream end and releases the gaseous solution through the diffuser into the discharge tube towards the downstream end.

In another embodiment, a nozzle assembly for expanding a foam solution comprises a discharge tube having a chamber with first and second ends. The first end has a front face with a first opening configured to be joined to a gas supply line that provides a gaseous solution and a second opening configured to receive non-expanded foam solution. The chamber receives the gaseous solution through the first opening. A diffuser is retained within the discharge tube and comprises a diffuser plate and a diffuser tube. The diffuser plate is located at the second end of the chamber and has at least one orifice for conveying the gaseous solution from the chamber to the discharge tube. The diffuser tube provides a conduit between the second opening in the front face and a nozzle acceptance hole in the diffuser plate. A foam solution spray nozzle is held within the nozzle acceptance hole of the diffuser. The foam solution spray nozzle receives the non-expanded foam solution through the conduit and discharges the non-expanded foam solution into the discharge tube through at least one nozzle orifice.

In another embodiment, a nozzle assembly for expanding a foam solution comprises a discharge tube having upstream and downstream ends. The discharge tube has a front face at the upstream end forming a barrier between ambient air outside the discharge tube and air within the discharge tube. The downstream end of the discharge tube is open. A chamber is formed within the discharge tube for receiving gaseous solution through a first opening proximate the upstream end. The first opening is configured to be joined to a gas supply line that provides a gaseous solution. The chamber has at least one orifice for releasing the gaseous solution from the chamber into the discharge tube towards the downstream end. A foam solution spray nozzle is held within the discharge tube for receiving non-expanded foam solution through a second opening proximate the upstream end. The foam solution spray nozzle discharges the foam solution with a velocity into the discharge tube towards the downstream end. A screen is retained proximate the downstream end of the discharge tube for receiving the non-expanded foam solution discharged from the foam solution spray nozzle. The gaseous solution and the velocity of the foam solution pushes the non-expanded foam solution through the screen to form bubbles encapsulating the gaseous solution.

The foregoing summary, as well as the following detailed description of certain embodiments of the present invention, will be better understood when read in conjunction with the appended drawings. It should be understood that the present invention is not limited to the arrangements and instrumentality shown in the attached drawings.

DETAILED DESCRIPTION OF THE INVENTION

Figure 1:
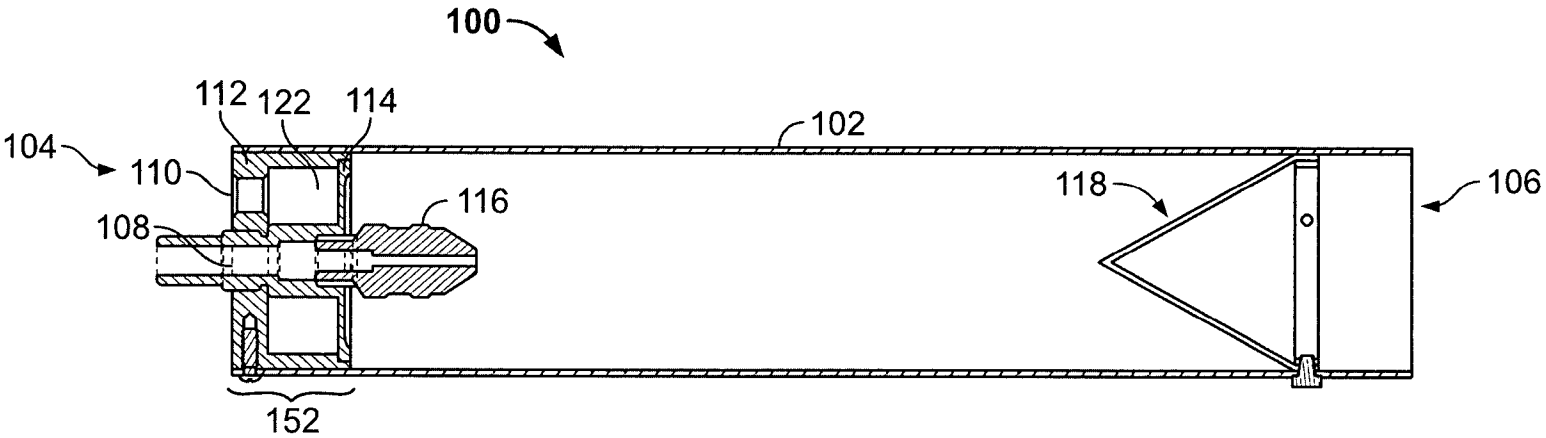
FIG. 1 illustrates a cross-sectional view of a nozzle assembly used to produce foam or bubbles encapsulating a desired gaseous solution in accordance with an embodiment of the present invention.

FIG. 1 illustrates a cross-sectional view of a nozzle assembly 100 used to produce foam or bubbles which encapsulate a desired gaseous solution in accordance with an embodiment of the present invention. A hollow cylindrical discharge tube 102 has an upstream end 104 and a downstream end 106. Sub-assembly 152 is mounted in the upstream end 104 of the discharge tube 102 and comprises a chamber forming portion 112 for receiving an inerting gas or gaseous solution, a diffuser 114 and a foam solution spray nozzle 116. The chamber forming portion 112 has a foam solution input opening 108 and a gaseous solution input opening 110. The diffuser 114 mounts within the chamber forming portion 112, extending through the foam solution input opening 108 and beyond the discharge tube 102. The foam solution spray nozzle 116 mounts within the diffuser 114. The sub-assembly 152 forms a chamber 122 or plenum which is sealed at the upstream end 104, with the exception of the gaseous solution input opening 110, from outside atmosphere or ambient air surrounding the nozzle assembly 100. A screen assembly 118 is located proximate the downstream end 106, which is open to the atmosphere outside the discharge tube 102.

Figure 2:
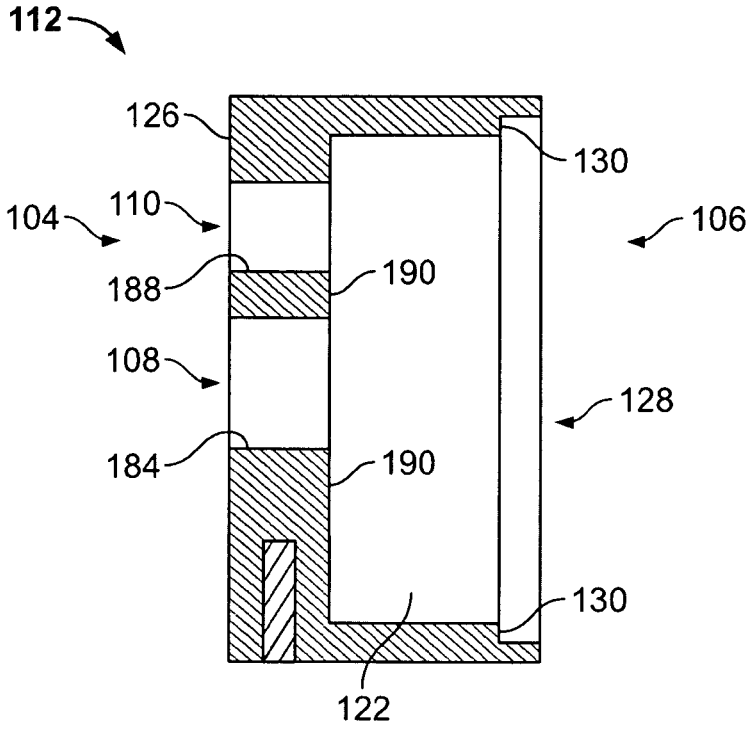
FIG. 2 illustrates a cross-sectional view of the gaseous solution chamber forming portion of the sub-assembly of FIG. 1 in accordance with an embodiment of the present invention.

FIG. 2 illustrates a cross-sectional view of the gaseous solution chamber forming portion 112 of the sub-assembly 152 of FIG. 1. The chamber forming portion 112 is cylindrical and may be formed of a single piece of metal or other material. The chamber forming portion 112 has a front face 126 and a back end 128 at opposite ends thereof. The foam solution input opening 108 and gaseous solution input opening 110 are formed in the front face 126. Inner surfaces 184 and 188 of the foam solution input opening 108 and gaseous solution input opening 110, respectively, may be threaded. The back end 128 faces the downstream end 106 and is substantially open. The back end 128 may have a groove 130 for accepting the diffuser 114. A chamber inner surface 190 forms an interior portion of the chamber 122.

Figure 3:
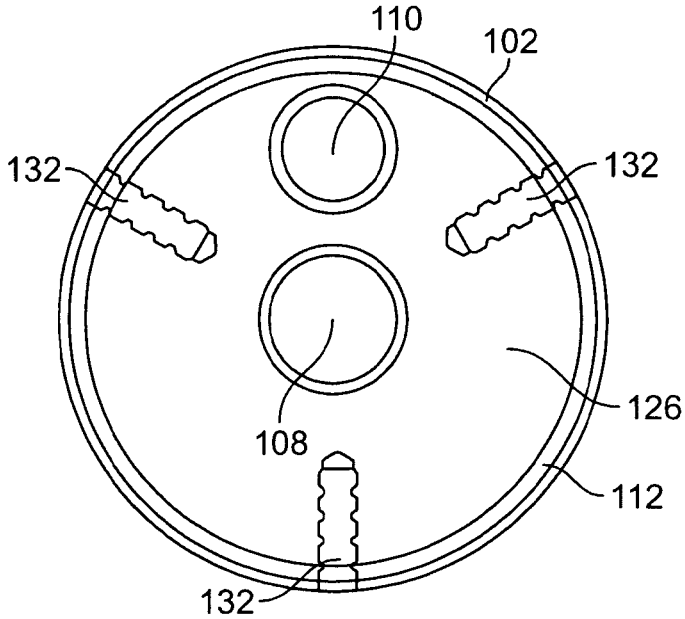
FIG. 3 illustrates the front face of the chamber forming portion of FIG. 2 when mounted within the discharge tube in accordance with an embodiment of the present invention.

FIG. 3 illustrates the front face 126 of the chamber forming portion 112 of FIG. 2 when mounted within the discharge tube 102. One or more fasteners 132 are used to interconnect the chamber forming portion 112 and the discharge tube 102. The fasteners 132 may be screws or other type of securing mechanism. In FIG. 3, three fasteners 132 are placed approximately equidistant from one another along the circumference of the discharge tube 102, although other arrangements may be used.

Figure 4:
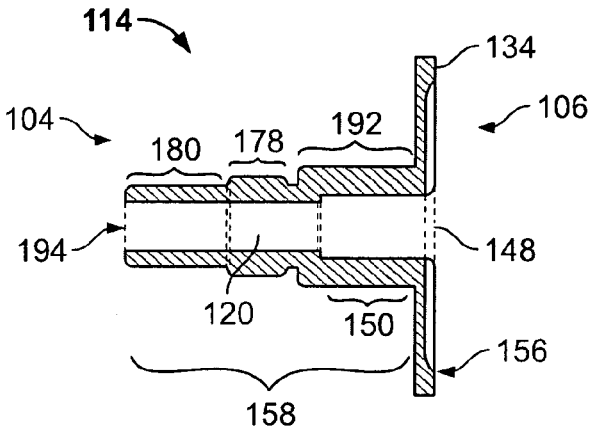
FIG. 4 illustrates a cross-sectional view of the diffuser assembly of the sub-assembly of FIG. 1 in accordance with an embodiment of the present invention.

FIG. 4 illustrates a cross-sectional view of the diffuser 114 of the sub-assembly 152 of FIG. 1. The diffuser 114 may be formed of a single piece of material and has a diffuser plate 156 and a diffuser tube 158. The diffuser plate 156 has a diffuser face 134 with a hole 148 therein for accepting the foam solution spray nozzle 116. A central portion 178 of the diffuser tube 158 is chamfered to have an outer diameter greater than an outer diameter of an upstream end portion 180. Downstream end portion 192 may have an outer diameter greater than the outer diameter of the central portion 178. The central portion 178 may be threaded externally, while a portion 150 of the downstream end portion 192 may be threaded internally to receive and retain the foam solution spray nozzle 116. The upstream end portion 180 may be threaded externally to receive a connector conveying the foam solution. A conduit 120 extends within the diffuser tube 158 between opening 194 at the upstream end 104 and the hole 148 in the downstream end 106.

Figure 5:
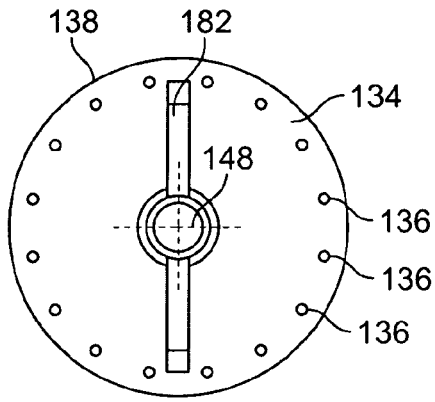
FIG. 5 illustrates the diffuser face of the diffuser of FIG. 4 in accordance with an embodiment of the present invention.

FIG. 5 illustrates the diffuser face 134 of the diffuser 114 of FIG. 4. The hole 148 is located within a central portion of the diffuser face 134. One or more orifices 136 are positioned proximate an outer edge 138 of the diffuser face 134. In the embodiment of FIG. 5, sixteen orifices 136 are positioned approximately equidistant along the outer edge 138. The gaseous solution moves through the orifices 136 from the upstream end 104 towards the downstream end 106. The number of orifices 136, as well as the size and position of each orifice 136, may be changed based on the desired flow volume, the size, shape and mesh parameters of the screen assembly 118, the characteristics of the foam solution, and the like. A shallow groove 182 or slot, used when assembling the sub-assembly 152, may be formed within the diffuser face 134.

Figure 6:
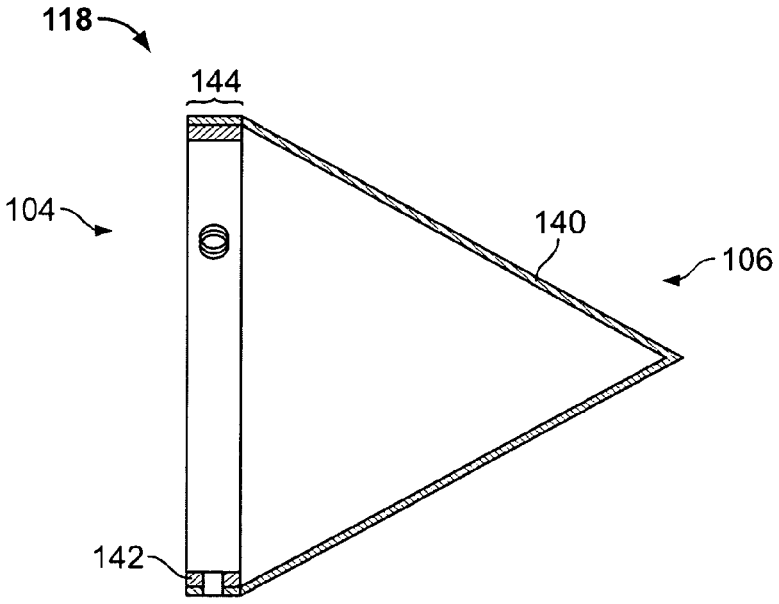
FIG. 6 illustrates a cross-sectional view of the screen assembly of FIG. 1 in accordance with an embodiment of the present invention.
Figure 9:
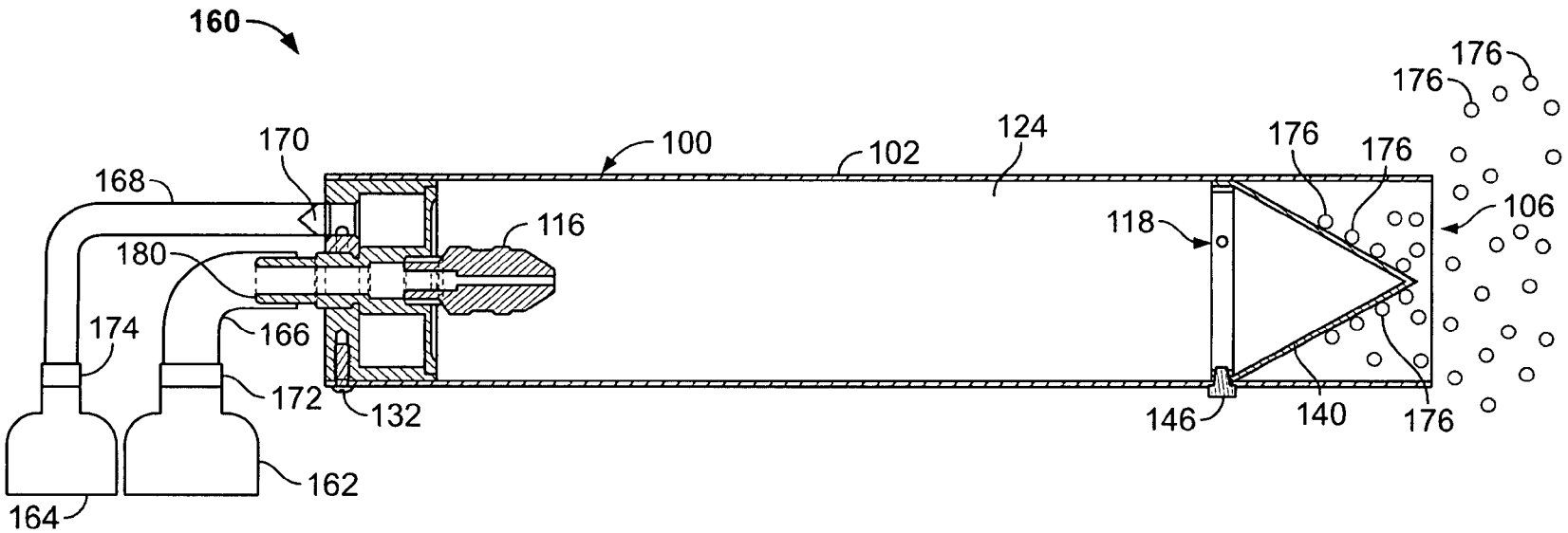
FIG. 9 illustrates a fire suppression assembly using the nozzle assembly of FIG. 1 to produce foam or bubbles which encapsulate a desired gaseous solution in accordance with an embodiment of the present invention.

FIG. 6 illustrates a cross-sectional view of the screen assembly 118 of FIG. 1. The screen assembly 118 has a conical shaped mesh screen 140 which may be soldered or otherwise affixed to a ring 142. The ring 142 is then attached to the discharge tube 102. Optionally, the screen assembly 118 may be formed of a single piece of material having an integral ring (not shown) which may be attached to the discharge tube 102 at screen attachment portion 144. The screen 140 may be cone-shaped as illustrated, or may be flat, curved or formed into any other shape to provide a desired screen surface area to produce a desired expansion of the foam solution. In FIGS. 6 and 9, the screen 140 is installed within the discharge tube 102 with the cone portion extending towards the downstream end 106, while in FIG. 1, the screen 140 is installed within the discharge tube 102 with the cone portion extending towards the upstream end 104.

The size of the mesh used in the screen 140 may be determined by the volume of area needed to fill or a desired expansion ratio, defining the ability to fill a container and the packing of the bubbles therein. Larger bubbles have a high expansion ratio, but lower thermal stability. Also, larger interstitial spaces exist between larger bubbles compared to smaller bubbles. Smaller bubbles formed by a smaller hole size in the mesh are more thermally stable, but also require more solution to produce.

Figure 7:
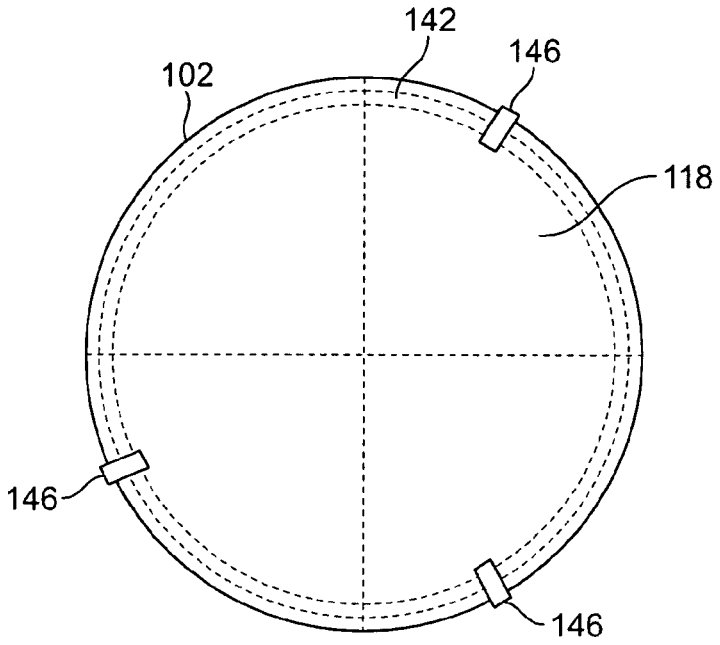
FIG. 7 illustrates a view of the screen assembly of FIG. 6 installed within the discharge tube of FIG. 1 in accordance with an embodiment of the present invention.

FIG. 7 illustrates a view of the screen assembly 118 of FIG. 6 installed within the discharge tube 102 of FIG. 1. The ring 142 is illustrated although a screen assembly 118 having an integral ring as discussed above may be used. The screen assembly 118 is secured within the discharge tube 102 with one or more fasteners 146 inserted through the ring 142 or the screen attachment portion 144. The fasteners 146 may be screws or other fastening mechanism.

Figure 8:
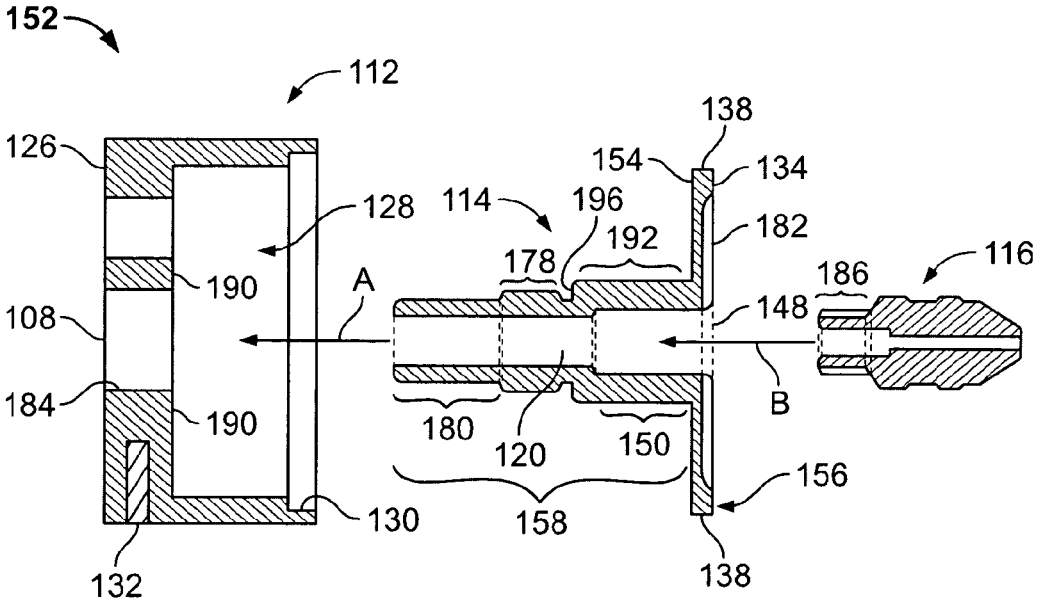
FIG. 8 illustrates an exploded view of the sub-assembly of FIG. 1 in accordance with an embodiment of the present invention.

FIG. 8 illustrates an exploded view of the sub-assembly 152 of FIG. 1. When joining the chamber forming portion 112 and the diffuser 114, the groove 182 in the diffuser face 134 may be utilized by a screwdriver or other tool. The diffuser tube 158 of the diffuser 114 is inserted into the back end 128 the chamber forming portion 112 in the direction of arrow A. The upstream end portion 180 of the diffuser tube 158 extends through the foam solution input opening 108 and beyond the front face 126. The central portion 178 of the diffuser tube 158 is threaded into the threaded inner surface 184 of the foam solution input opening 108. An outer edge 138 and upstream face 154 of the diffuser plate 156 rest against the groove 130 of the chamber forming portion 112 and an edge 196 of the downstream end portion 192 rests against the chamber inner surface 190. The foam solution spray nozzle 116 is threaded externally on portion 186, which is inserted through the hole 148 in the direction of arrow B and threaded into the threaded portion 150 of the conduit 120 of the diffuser tube 158. Other interfacing mechanisms may be used to secure the chamber forming portion 112 and the diffuser 114 together, as well as securing the foam solution spray nozzle 116 and the diffuser 114.

FIG. 9 illustrates a fire suppression assembly 160 using the nozzle assembly 100 of FIG. 1 to produce foam or bubbles which encapsulate a desired gaseous solution. The nozzle assembly 100 is assembled by securing the sub-assembly 152 (FIGS. 1 and 8) inside the discharge tube 102 proximate the upstream end 104 using the fasteners 132 (FIG. 3). The screen assembly 118 is secured within the discharge tube 102 proximate the downstream end 106 with the fasteners 146 (FIG. 7). The distance between the foam solution spray nozzle 116 and the screen assembly 118 may be determined by the spray pattern of the foam solution spray nozzle 116 over a range of flow rates used by the assembly 160.

Foam solution container 162 holds the foam solution under pressure. Alternatively, the foam solution container 162 may be an atmospheric tank with pressurized foam solution being supplied by means of a pump (not shown) located between the foam solution container 162 and the upstream end portion 180. The expansion ratio of foam is classified by the National Fire Protection Association. For example, medium expansion foam has an expansion ratio from 20:1 to 200:1. Medium expansion foam may be appropriate when the assembly 160 is used to provide protection for a cargo container.

Gaseous solution container 164 holds the gaseous solution under pressure. The gaseous solution may be any single inert gas or combination of inert gases. For example, Nitrogen, Argon, Helium, other inert gas, or a blend of more than one inert gas may be used. The foam solution may be a water-based or a non-aqueous solution. Additional components, such as polymers, may be used to achieve desired characteristics, such as drainage rate, elasticity, and thermal stability, and elasticity. For example, within a cargo container transported in an airplane, pressure changes occur due to changes in altitude. The bubbles are desired to have an elastic property to allow swelling and shrinking without breakage.

Foam solution supply line 166 connects the foam solution container 162 to the nozzle assembly 100. The foam solution supply line 166 may be a hose, tubing or other conduit, and is securely fastened to the upstream end portion 180 of the diffuser tube 158 of the diffuser 114. The upstream end portion 180 may be threaded externally, allowing the foam solution supply line 166 and/or other connector to be threaded thereon. Alternatively, the foam solution supply line 166 and the upstream end portion 180 may be fastened together using a clamp or other fastener.

Gaseous solution supply line 168 connects the gaseous solution container 164 to the nozzle assembly 100. The gaseous solution supply line 168 may also be a hose, tubing or other conduit. As stated previously, the inner surface 188 (FIG. 2) of the gaseous solution input opening 110 may be threaded to receive and hold a pipe nipple 170. The gaseous solution supply line 168 fastens to the pipe nipple 170. Other connectors or fasteners may be used. Each of the foam and gaseous solution containers 162 and 164 may be interconnected to one or more than one nozzle assembly 100.

A controller of a fire suppression system (not shown) may be used to control the nozzle assembly 100 or a plurality of nozzle assemblies 100. Each nozzle assembly 100 may be dedicated to protect an area, such as a hazardous material storage building or paint locker within a building, or a cargo container within the cargo hold of an airplane. When the controller detects a thermal event or other fire related event, the controller determines which of the nozzle assemblies 100 are located in a position proximate the thermal event. The controller then activates actuators 172 and 174 or other mechanism to open the foam and gaseous solution containers 162 and 164. For example, one or both of the foam and gaseous solution containers 162 and 164 may be sealed with foil or other material which may be punctured, or may be accessed by opening a valve. Alternatively, the actuator 172 may start a pump (not shown) to pump foam solution out of the foam solution container 162.

The foam solution discharges from the foam solution container 162, is conveyed by the foam solution supply line 166 and enters the conduit 120 within the foam solution input opening 108. The foam solution sprays out of the foam solution spray nozzle 116 into an inner portion 124 of the discharge tube 102 and onto the screen 140 of the screen assembly 118. At the same time, the gaseous solution discharges from the gaseous solution container 164, is conveyed through the gaseous solution supply line 168, through the pipe nipple 170 held within the gaseous solution input opening 110 and into the chamber 122. The gaseous solution under pressure pushes the gaseous solution through the orifices 136 in the diffuser face 134 into the discharge tube 102. Referring again to FIG. 5, the gaseous solution is distributed evenly within the inner portion 124 by the orifices 136 which are placed along the outer edge 138 of the diffuser face 134. The gaseous solution and the velocity of the foam solution from the foam solution spray nozzle 116 pushes the foam solution through the mesh or holes of the screen 140, forming bubbles 176 which together form a uniform foam blanket Because the upstream end 104 of the chamber 122 (or plenum) is sealed to prevent ambient air from entering or being pulled into the discharge tube 102, and the discharge tube 102 has no other orifice formed therein, no ambient air is pulled into the discharge tube 102 as the bubbles 176 are formed. In other words, the front face 126 forms a barrier at the upstream end 104 between the ambient air outside the discharge tube 102 and the air inside the discharge tube 102. Therefore, the foam solution encapsulates the gaseous solution within the bubbles 176. The pressure of the gaseous solution moving through the discharge tube 102 and the creation of more bubbles 176 pushes the bubbles 176 out of the open downstream end 106 of the discharge tube 102 and into the area where fire suppression is desired.

The bubbles 176 form a foam blanket that displaces other air within the container by pushing the ambient air out through any openings in the container. Therefore, the inerting gaseous solution, and thus also the air in the container, is essentially "thickened" by the bubbles 176, which helps to retain the gaseous solution within the container rather than allowing the gaseous solution to mix with and be pushed out with the ambient air (oxygen supply).

The bubbles 176 or foam blanket will extinguish the fire with its smothering, cooling and wetting effect. When the bubbles 176 eventually burst, the inert gas, which does not support combustion, is liberated. This is especially important for Class A combustibles such as paper and wood that burn with both flaming combustion and deep seated combustion. The foam both cools and wets the deep seated ember and the inert atmosphere suppresses any continued combustion.

The chamber or sealed plenum may also be used in foam expansion assemblies when high expansion foam encasing a gaseous solution is desired, such as in an aircraft hanger, a warehouse, a tunnel, mine or other large enclosed area. High expansion foam may have, for example, expansion ratios greater than 200:1.

Figure 10:
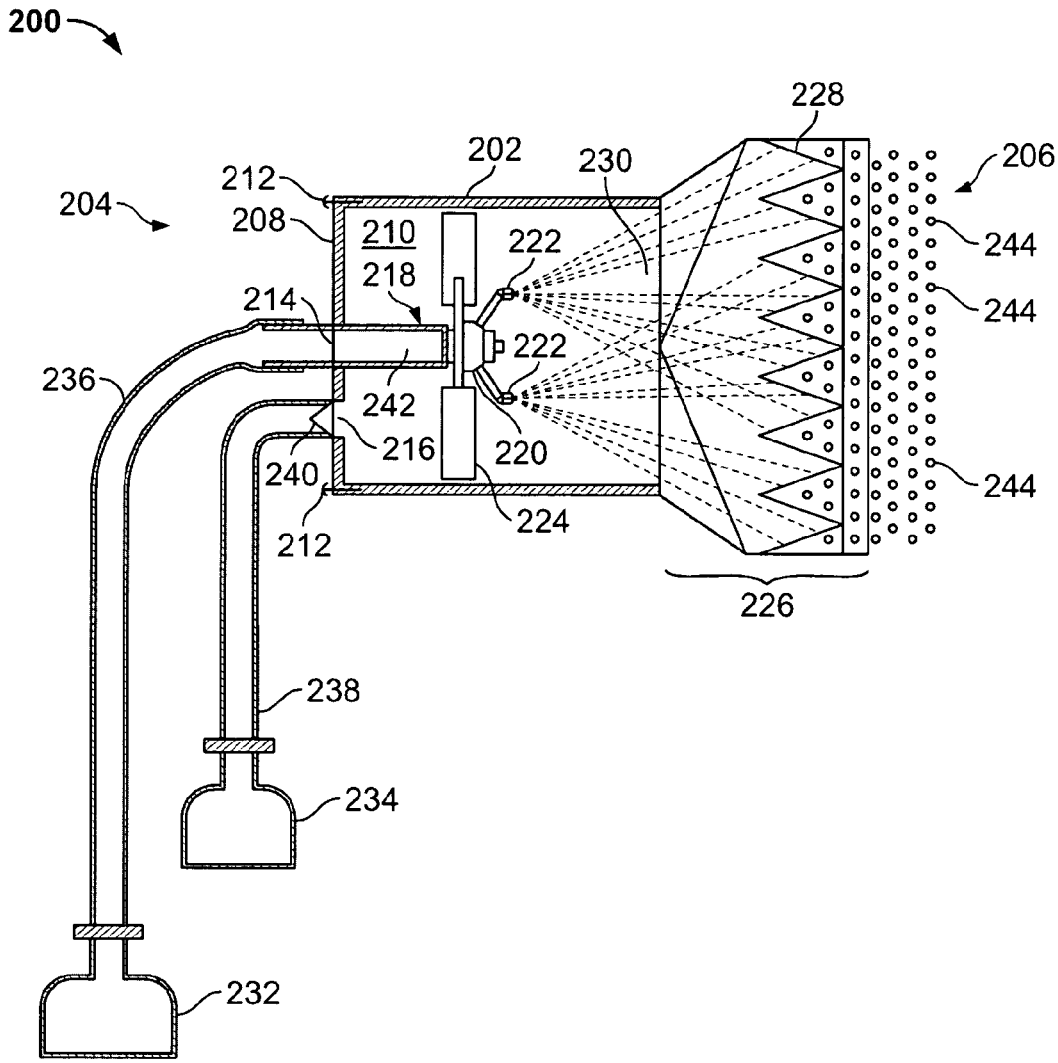
FIG. 10 illustrates a cross-sectional view of a foam expansion assembly for encapsulating a desired gaseous solution within a high expansion foam solution in accordance with an embodiment of the present invention.

FIG. 10 illustrates a cross sectional view of a foam expansion assembly 200 for encapsulating a desired gaseous solution within a high expansion foam solution. A hollow cylindrical discharge tube 202 has an upstream end 204 and a downstream end 206. A front face 208 is formed of a solid disk or cap of sheet material to form a chamber 210 or plenum sealed from outside atmosphere or ambient air at the upstream end 204. The front face 208 may be welded, attached with fasteners 212, or otherwise secured to the discharge tube 202. The front face 208 has a foam solution input opening 214 and a gaseous solution input opening 216.

An inner surface of the foam solution input opening 214 may be threaded for receiving and securing a tube 218 which extends beyond the front face 208. The downstream end of the tube 218 may be threaded to receive a nozzle assembly 220. The nozzle assembly 220 may have one or more foam solution spray nozzles 222. Optionally, the nozzle assembly 220 may also have a blower fan 224, which may be driven by the flow of the foam solution or by electrical power (not shown). When the blower fan 224 rotates, the foam solution spray nozzles 222, which are canted at an angle, are also rotated.

Screen assembly 226 extends from open end 230 proximate the downstream end 206 of the discharge tube 202. The screen assembly 226 may have an inner diameter which is larger than an inner diameter of the discharge tube 202, allowing screen 228 to have a greater surface area. The screen assembly 226 may be formed integral with the discharge tube 202, or may be a separate piece which is welded, riveted, or otherwise securely attached thereto. The screen 228 has multiple cones formed therein, although it should be understood that the screen 228 may be formed in other shapes and contours. The screen assembly 226 may be square in shape proximate the downstream end 206 to allow easier construction of the screen 228.

Connecting foam and gas solution containers to the foam expansion assembly 200 may be accomplished similar to the assembly 160 of FIG. 9, or other connections or fasteners known in the art may be used. Foam solution container 232 holds the foam solution under pressure. As stated previously, the foam solution container 232 may also be an atmospheric tank with pressurized foam solution which is supplied with a pump (not shown). Gaseous solution container 234 holds the gaseous solution under pressure. Foam solution supply line 236 connects the foam solution container 232 to the tube 218 and gaseous solution supply line 238 connects the gaseous solution container 234 to the gaseous solution input opening 216, such as with a pipe nipple 240.

The foam solution discharged from foam solution container 232 is conveyed by the foam solution supply line 236 and enters conduit 242 within the foam solution input opening 214. At the same time, the gaseous solution discharges from the gaseous solution container 234, is conveyed through the gaseous solution supply line 238, through the pipe nipple 240 held within the gaseous solution input opening 216 and into the chamber 210. The flow rate of the gaseous solution may be determined by the desired rate of foam production. For example, if 5000 cubic feet of foam per minute is desired, the flow rate of the gaseous solution would also be approximately 5000 cubic feet per minute The foam solution spray nozzles 222 spray the foam solution into the discharge tube 202 and onto the screen 228. The foam solution may also drive the blower fan 224 which helps to pull the gaseous solution within the chamber 210 towards the downstream end 206 and push the foam solution through the screen 228. Alternatively, the nozzle assembly 220 may have one or more air aspirating high expansion nozzles without an accompanying blower fan. The high expansion nozzle uses the Venturi effect to draw the gaseous solution downstream with the velocity of the foam solution stream. The velocity of the gaseous solution pushes the foam solution through the screen 228. The foam solution encapsulates the gaseous solution within bubbles 244 which are discharged out of the downstream end 206 of the screen assembly 226.

While the invention has been described in terms of various specific embodiments, those skilled in the art will recognize that the invention can be practiced with modification within the spirit and scope of the claims.

What is claimed:

1. A nozzle assembly for encapsulating an inert gaseous solution in bubbles, comprising:

a discharge tube having upstream and downstream ends, the discharge tube having the upstream end consisting of first and second inlet openings, the first inlet opening configured to be joined to an inert gas supply line that provides the inert gaseous solution to an interior of the discharge tube, the second inlet opening configured to be joined to a non-expanded foam solution supply that provides a non-expanded foam solution to the interior of the discharge tube, the downstream end of the discharge tube having a screen, the screen being cone-shaped with a cone portion extending towards the upstream end and being open to ambient air;

a diffuser;

a chamber formed within the interior of the discharge tube, the chamber receiving the inert gaseous solution at the upstream end and releasing the inert gaseous solution through the diffuser into the discharge tube towards the downstream end; and a foam solution spray nozzle held within the discharge tube along an axis of the discharge tube, and located upstream of the screen and spaced a distance from the screen, and communicating with the second inlet opening to supply from an opening that faces the screen the non-expanded foam solution-along the discharge tube towards the screen.

2. The nozzle assembly of claim 1, wherein a front face of the discharge tube forms a barrier that prevents ambient air from entering the discharge tube upstream of the foam solution spray nozzle when the inert gas supply line is joined to the first inlet opening.

3. The nozzle assembly of claim 1, the diffuser further comprising a plurality of orifices for distributing the inert gaseous solution within the discharge tube.

4. The nozzle assembly of claim 1, wherein the screen is retained within the discharge tube downstream of the foam solution spray nozzle, the screen receiving the non-expanded foam solution when discharged from the foam solution spray nozzle, the inert gaseous solution pushing the non-expanded foam solution through the screen to form bubbles encapsulating the inert gaseous solution.

5. The nozzle assembly of claim 1, wherein the chamber receives the diffuser and is secured to the discharge tube with at least one fastener.

6. The nozzle assembly of claim 1, further comprising a conduit extending between the second inlet opening and the foam solution spray nozzle for conveying the foam solution therebetween.

7. The nozzle assembly of claim 1, further comprising means for interconnecting a first container of the inert gaseous solution with the first inlet opening.

8. The nozzle assembly of claim 7, further comprising means for interconnecting a second container of the non-expanded foam solution with the second inlet opening.

9. A nozzle assembly for expanding a medium expansion foam solution, comprising;

a discharge tube having upstream and downstream ends, the discharge tube having a front face at the upstream end forming a barrier between ambient air outside the discharge tube and an interior of the discharge tube, the downstream end of the discharge tube being open, the upstream end consisting of first and second inlet openings;

a chamber formed within the discharge tube for receiving an inert gaseous solution through the first inlet opening, the first inlet opening configured to be joined to an inert gas supply line that provides the inert gaseous solution, the chamber having at least one orifice for releasing the inert gaseous solution from the chamber into the discharge tube towards the downstream end of the discharge tube;

a foam solution spray nozzle held along an interior axis of the discharge tube for receiving non-expanded foam solution through the second inlet opening, the foam solution spray nozzle discharging the foam solution from an opening exposed to the downstream end of the discharge tube with a velocity into the discharge tube downstream of the chamber; and a screen retained proximate the downstream end of the discharge tube and spaced a distance along the discharge tube from the foam solution spray nozzle for receiving the non-expanded foam solution discharged from the spray nozzle, the inert gaseous solution and the velocity of the foam solution pushing the non-expanded foam solution through the screen to form bubbles encapsulating the inert gaseous solution.

10. The nozzle assembly of claim 9, wherein the front face has the first and second inlet openings formed therein, the front face forming a portion of the chamber.

11. The nozzle assembly of claim 9, the screen further comprising a conical-shaped mesh screen.

12. The nozzle assembly of claim 9, further comprising a conduit extending between the second inlet opening and the spray nozzle for conveying the foam solution therebetween, the conduit extending beyond the front face and joined to a foam solution supply line.

13. The nozzle assembly of claim 9, further comprising:

the spray nozzle further comprising a foam solution acceptance end receiving the non-expanded foam solution, the foam solution acceptance end being externally threaded; and a conduit extending between the second inlet opening and the spray nozzle for conveying the foam solution therebetween, the conduit being internally threaded and accepting the foam solution acceptance end of the spray nozzle.

14. The nozzle assembly of claim 9, further comprising an inert gaseous container holding the inert gaseous solution, and the inert gas supply line connecting the container to the first inlet opening.

15. The nozzle assembly of claim 9, further comprising an inert gas supply line that delivers the inert gaseous solution to the first inlet opening.

16. A method for encapsulating an inert gaseous solution within bubbles of a foam solution, comprising:

delivering through a first inlet opening a pressurized inert gaseous solution from a tank to an upstream end of an expansion nozzle;

delivering through a second inlet opening a pressurized foam solution from a tank to the upstream end of the expansion nozzle;

diffusing the inert gaseous solution as the inert gaseous solution moves from the upstream end into an inner portion of the expansion nozzle;

spraying the foam solution into the inner portion of the expansion nozzle from an opening of a foam solution spray nozzle into the expansion nozzle, the foam solution and the inert gaseous solution moving along the inner portion to the downstream end of the expansion nozzle; and expanding the foam solution to form bubbles that encapsulate the inert gaseous solution at a screen, the screen being spaced a distance from the expansion nozzle and conical shaped with the conical portion extending towards the upstream end as the foam solution and inert gaseous solution are discharged from the downstream end of the expansion nozzle.

17. The method of claim 16, wherein the expanding operation includes pushing the foam solution through the screen to form the bubbles that encapsulate the inert gaseous solution in the foam solution.

18. The method of claim 16, wherein the diffusing operation moves the inert gaseous solution through multiple orifices placed along an outer edge of a diffuser face located at the upstream end of the expansion nozzle.

19. The method of claim 16, wherein the diffusing operation moves the inert gaseous solution through orifices in a diffuser face located at the upstream end of the expansion nozzle to evenly distribute the inert gaseous solution within the inner portion of the expansion nozzle.

20. The method of claim 16, further comprising controlling a flow rate of the inert gaseous solution to the expansion nozzle to produce an expanded foam solution at a desired rate.

21. The method of claim 16, further comprising delivering the bubbles of the foam solution encapsulating the inert gaseous solution to a hazardous environment.

22. A fire suppression assembly for expanding a non-expanded foam solution encapsulating an inert gaseous solution, comprising:

a first container holding a pressurized inert gaseous solution;

an inert gas supply line connected to the first container;

a second container holding a pressurized non-expanded foam solution;

a foam solution supply line connected to the second container;

a discharge tube that includes upstream and downstream ends, the discharge tube consisting of a first inlet opening being located proximate the upstream end and joined to the first container through the inert gas supply line to provide the inert gaseous solution to the discharge tube, the discharge tube further consisting of a second inlet opening being located proximate the upstream end and joined to the second container through the foam solution supply line to provide the non-expanded foam solution to the discharge tube;

a diffuser retained within the discharge tube to diffuse the inert gaseous solution; and a foam solution spray nozzle held within the discharge tube along an axis of the discharge tube, the foam solution spray nozzle receiving the non-expanded foam solution and discharging the non-expanded foam solution from an opening facing the downstream end of the discharge tube through at least one nozzle orifice into the discharge tube towards a screen at the downstream end of the discharge tube, the screen being spaced along the discharge tube from the foam solution spray nozzle.

23. The assembly of claim 22, wherein the diffuser includes a diffuser plate having a plurality of orifices spaced proximate an outer edge of the diffuser plate.

24. The assembly of claim 22, wherein the second inlet opening is internally threaded and the diffuser is externally threaded to retain the diffuser within the discharge tube.

25. The assembly of claim 22, wherein the first inlet opening is internally threaded, the assembly further comprising a pipe nipple threaded into the first inlet opening for receiving the inert gas supply line.

26. The assembly of claim 22, wherein the diffuser includes a diffuser tube and extends beyond a front face of the discharge tube to form an upstream end portion, the upstream end portion being externally threaded to receive a connector joined to a foam solution supply line that supplies the non-expanded foam solution.

27. The assembly of claim 22, wherein the discharge tube includes a chamber having a first end and a second end, the diffuser comprising a diffuser plate and a diffuser tube, the diffuser plate located at the second end of the chamber and having at least one orifice for conveying the inert gaseous solution from the second end of the chamber to an inner portion of the discharge tube, the diffuser tube providing a conduit between the second inlet opening and a nozzle acceptance hole in the diffuser plate.

28. A fire suppression assembly for delivering a foam formed of a non-expanded foam solution forming a plurality of bubbles each enclosing an inert gas, the assembly comprising:

a first container holding a first fluid consisting of a pressurized inert gas;

a second container holding a second fluid consisting of a pressurized non-expanded foam solution; and at least one nozzle assembly having an upstream end and an opposing downstream end disposed on an axis of the at least one nozzle assembly, the upstream end having a surface having only two inlets at the upstream end, the surface preventing the ingress of ambient air into an interior of the nozzle assembly via the upstream end, the nozzle assembly comprising:

a first supply inlet of the only two inlets at the upstream end communicating with the first container to supply the inert gas to the interior of the at least one nozzle assembly;

a diffuser having a plurality of orifices for distributing the inert gas within the interior of the at least one nozzle assembly;

a second supply inlet of the only two inlets at the upstream end communicating with the second container to supply a flow of the non-expanded foam solution to the interior of the at least one nozzle assembly;

a conical screen disposed on the axis at the downstream end to receive the flow of the non-expanded foam solution, an apex of the conical screen facing the upstream end of the nozzle assembly; and a nozzle at the upstream end communicating with the second container and disposed along the axis to direct the flow of the non-expanded foam solution towards the screen to coat the screen, the screen including a plurality of passages sized to form the plurality of bubbles when the inert gas passes through the coated screen.

29. The assembly of claim 28, further comprising:

a controller operatively connected to control an operation of the at least one nozzle assembly.

30. The assembly of claim 29, wherein the at least one nozzle assembly is a plurality of nozzle assemblies, the controller being operatively connected to control the operation of each of the plurality of nozzle assemblies.

31. The assembly of claim 30, wherein each of the plurality of nozzle assemblies is dedicated to a protected area.

32. The assembly of claim 31, wherein the protected area is a cargo container within a cargo hold of an airplane.

* * * * *